US010842215B2

(12) United States Patent
Woods

(10) Patent No.: US 10,842,215 B2
(45) Date of Patent: Nov. 24, 2020

(54) CAPSKINZ AND METHODS OF USING SAME

(71) Applicant: Marlon Woods, East Stroudsburg, PA (US)

(72) Inventor: Marlon Woods, East Stroudsburg, PA (US)

( * ) Notice: Subject to any disclaimer, the term of this patent is extended or adjusted under 35 U.S.C. 154(b) by 231 days.

(21) Appl. No.: 16/175,914

(22) Filed: Oct. 31, 2018

(65) Prior Publication Data

US 2019/0059491 A1 Feb. 28, 2019

Related U.S. Application Data

(63) Continuation-in-part of application No. 15/793,716, filed on Oct. 25, 2017, now abandoned.

(60) Provisional application No. 62/413,965, filed on Oct. 27, 2016.

(51) Int. Cl.
*A42B 1/18* (2006.01)
*A42B 1/06* (2006.01)

(52) U.S. Cl.
CPC ..... *A42B 1/18* (2013.01); *A42B 1/062* (2013.01)

(58) Field of Classification Search
CPC .... A42B 1/02; A42B 1/22; A42B 1/18; A42B 1/24
See application file for complete search history.

(56) References Cited

U.S. PATENT DOCUMENTS 2,677,457 A 5/1954 Guest
3,166,766 A 1/1965 Banello, Jr.
4,180,868 A 1/1980 Snow
4,192,017 A 3/1980 Fay
4,316,289 A 2/1982 Hild
4,969,317 A 11/1990 Ode
5,031,388 A 7/1991 Ode
5,481,759 A 1/1996 Rinaldi
5,669,075 A 9/1997 Weeks
6,052,830 A 4/2000 Payne
6,061,836 A 5/2000 Peters
(Continued)

FOREIGN PATENT DOCUMENTS

AU 585067 3/1987
AU 2005100107 3/2005
(Continued)

*Primary Examiner* — Gloria M Hale
(74) *Attorney, Agent, or Firm* — James R. McDaniel

(57) ABSTRACT

A headwear apparatus for covering and protecting an article of headwear such as a cap, including an article of headwear having a head receiving portion sized to receive the head of a user when the headwear is worn by the user, a forward extending visor portion attached to the head receiving portion, and a sweat band portion located around a periphery of the head receiving portion; and a protective headwear cover that covers and protects the article of headwear, wherein the protective headwear cover further includes a protective headwear cover head receiving portion operatively attached to a protective headwear cover visor portion, wherein the protective headwear cover head receiving portion is located over the head receiving portion and the protective headwear cover visor portion is located over the visor portion, and an adjustable band located around a periphery of the protective headwear cover head receiving portion and adjacent to the protective headwear cover visor portion such that the adjustable band is located adjacent to the sweat band portion.

2 Claims, 3 Drawing Sheets

(56) References Cited

U.S. PATENT DOCUMENTS

| | | | |
|---|---|---|---|
| 6,711,752 | B2 | 3/2004 | Smith |
| 7,096,512 | B2 | 8/2006 | Blair |
| 7,871,040 | B2 | 1/2011 | Lee et al. |
| 7,971,278 | B2 | 7/2011 | Klamerus, Jr. |
| 9,427,038 | B2 | 8/2016 | Bundy |
| 9,629,407 | B2 | 4/2017 | Foster |
| 9,706,824 | B2 | 7/2017 | Tuning |
| 2005/0086727 | A1 | 4/2005 | Shen |
| 2005/0246825 | A1 | 11/2005 | Ruhl |
| 2008/0111024 | A1 | 5/2008 | Lee et al. |
| 2010/0031425 | A1 | 2/2010 | Klamerus, Jr. |
| 2010/0064408 | A1 | 3/2010 | Kemper |
| 2011/0296579 | A1 | 12/2011 | Galvin |
| 2013/0174321 | A1 | 7/2013 | Bundy |
| 2014/0298567 | A1 | 10/2014 | Potts |
| 2015/0047111 | A1 | 2/2015 | Foster |
| 2016/0315830 | A1 | 10/2016 | Sotzing |
| 2016/0360816 | A1 | 12/2016 | Bundy |
| 2017/0127778 | A1 | 5/2017 | Tuning |

FOREIGN PATENT DOCUMENTS

| | | |
|---|---|---|
| CA | 2167619 | 3/1997 |
| CA | 2919770 | 7/2017 |
| CN | 1068491 | 2/1993 |
| CN | 2207092 | 9/1995 |
| CN | 202496858 | 10/2012 |
| CN | 103445374 | 12/2013 |
| GB | 2374271 | 10/2002 |
| JP | 2005350838 | 12/2005 |
| KR | 200191091 | 8/2000 |
| KR | 1020010090064 | 10/2001 |
| KR | 200272808 | 4/2002 |
| KR | 100866347 | 10/2008 |
| KR | 2020090011468 | 11/2009 |
| KR | 102011004294 | 4/2011 |
| KR | 2020120007446 | 10/2012 |
| KR | 1020160099262 | 8/2016 |
| WO | WO2002074116 | 9/2002 |
| WO | WO2008065779 | 6/2008 |
| WO | WO2008108826 | 11/2008 |

CAPSKINZ AND METHODS OF USING SAME

CROSS-REFERENCE TO RELATED APPLICATIONS

This application is a continuation-in-part of U.S. patent application Ser. No. 15/793,716, filed on Oct. 25, 2017, now abandoned, which is a continuation-in-part of U.S. Provisional Patent Application Ser. No. 62/413,965, filed Oct. 27, 2016, the disclosures of which are hereby incorporated by reference in their entirety to provide continuity of disclosure to the extent such disclosures are not inconsistent with the disclosure herein.

FIELD OF THE INVENTION

The present invention is generally related to a water-resistant or waterproof hat cover or CapSkinz that is designed to protect a cap such as a baseball cap from the elements and preserve the overall condition of the cap. Baseball caps have become collector's items and, therefore, have become expensive to own so the cap purchaser desires a way to protect the quality and integrity of the cap. The CapSkinz hat accessory protects the investment of a hat by ensuring that it is not ruined by weather damage and can also be used indoors as a storage item to protect the hat from dirt debris and staining.

It offers barrier between the cap and everyday elements, such as rain, snow, and ultraviolet radiation exposure. The present invention allows individuals to protect their hat, while also providing a cover in various colors and designs to offer a new and unique style.

BACKGROUND OF THE INVENTION

Prior to the present invention, as set forth in general terms above and more specifically below, it is known, to employ various types of protective devices for caps such as baseball caps. See for example, U.S. Pat. No. 2,677,457 by Guest, U.S. Pat. No. 5,481,759 by Rinaldi, U.S. Pat. No. 6,061,836 by Peters, U.S. Pat. No. 7,096,512 by Blair, U.S. Patent Application Publication 2005/0086727 by Shen, and U.S. Patent Application Publication 2005/0246825 by Ruhl. While these various protective devices for caps such as baseball caps may have been generally satisfactory, there is nevertheless a need for a new and improved water-resistant or waterproof hat cover or CapSkinz that is designed to protect a cap such as a baseball cap from the elements.

It is a purpose of this invention to fulfill these and other needs in the protective devices for caps art in a manner more apparent to the skilled artisan once given the following disclosure.

BRIEF SUMMARY OF THE INVENTION

A first aspect of the present invention is a headwear apparatus for covering and protecting an article of headwear such as a cap, including an article of headwear having a head receiving portion sized to receive the head of a user when the headwear is worn by the user, a forward extending visor portion attached to the head receiving portion, and a sweat band portion located around a periphery of the head receiving portion; and a protective headwear cover that covers and protects the article of headwear, wherein the protective headwear cover further includes a protective headwear cover head receiving portion operatively attached to a protective headwear cover visor portion, wherein the protective headwear cover head receiving portion is located over the head receiving portion and the protective headwear cover visor portion is located over the visor portion, and an adjustable band located around a periphery of the protective headwear cover head receiving portion and adjacent to the protective headwear cover visor portion such that the adjustable band is located adjacent to the sweat band portion.

In one embodiment of the first aspect of the present invention, the protective headwear cover includes a water-resistant or waterproof material.

In another embodiment of the first aspect of the present invention, the protective headwear cover is constructed of Nylon.

In another embodiment of the first aspect of the present invention, the protective headwear cover is constructed of a fabric blend of Nylon and Lycra.

In another embodiment of the first aspect of the present invention, the protective headwear cover is constructed of a fabric blend of 85% Nylon and 1 Lycra.

In still another embodiment of the first aspect of the present invention, the protective headwear cover is constructed of a fabric blend of polyester and Spandex®.

In an even further embodiment of the first aspect of the present invention, the protective headwear cover is constructed of a fabric blend of 96% polyester and 4% Spandex®.

A second aspect of the present invention is a slip-on cover for covering and protecting an article of headwear such as a cap, including an article of headwear having a head receiving portion sized to receive the head of a user when the headwear is worn by the user, a forward extending visor portion attached to the head receiving portion, and a sweat band portion located around a periphery of the head receiving portion; and a protective headwear cover that covers and protects the article of headwear, wherein the protective headwear cover further including a protective headwear cover head receiving portion operatively attached to a protective headwear cover visor portion, wherein the protective headwear cover head receiving portion is located over the head receiving portion and the protective headwear cover visor portion is located over the visor portion, and an adjustable band located around a periphery of the protective headwear cover head receiving portion and adjacent to the protective headwear cover visor portion such that the adjustable band is located adjacent to the sweat band portion.

In one embodiment of the second aspect of the present invention, the protective headwear cover includes a water-resistant or waterproof material.

In another embodiment of the second aspect of the present invention, the protective headwear cover is constructed of Nylon.

In another embodiment of the second aspect of the present invention, the protective headwear cover is constructed of a fabric blend of Nylon and Lycra.

In another embodiment of the second aspect of the present invention, the protective headwear cover is constructed of a fabric blend of 85% Nylon and 15% Lycra.

In still another embodiment of the second aspect of the present invention, the protective headwear cover is constructed of a fabric blend of polyester and Spandex®.

In an even further embodiment of the second aspect of the present invention, the protective headwear cover is constructed of a fabric blend of 96% polyester and 4% Spandex®.

A third aspect of the present invention is a method of providing a headwear apparatus for covering and protecting an article of headwear such as a cap, including the steps of: providing an article of headwear having a head receiving portion sized to receive the head of a user when the headwear is worn by the user, a forward extending visor portion attached to the head receiving portion, and a sweat band portion located around a periphery of the head receiving portion; providing a protective headwear cover that covers and protects the article of headwear, wherein the protective headwear cover further includes; a protective headwear cover head receiving portion operatively attached to a protective headwear cover visor portion, wherein the protective headwear cover head receiving portion is located over the head receiving portion and the protective headwear cover visor portion is located over the visor portion, and an adjustable band located around a periphery of the protective headwear cover head receiving portion and adjacent to the protective headwear cover visor portion such that the adjustable band is located adjacent to the sweat band portion; and placing the protective headwear cover over the article of headwear such that the protective headwear cover head receiving portion is located over the head receiving portion, the protective headwear cover visor portion is located over the visor portion, and the adjustable band is located adjacent to the sweat band portion.

In one embodiment of the third aspect of the present invention, the providing a protective headwear cover that covers and protects the article of headwear step further includes the step of applying a water-resistant or waterproof material to the protective headwear cover for increased water protection.

In another embodiment of the third aspect of the present invention, the providing a protective headwear cover that covers and protects the article of headwear step further includes the step of constructing the protective headwear cover of a durable, fade resistant, UV stabilized, temperature resistant, and wear resistant material such as fabric, leather, cellulose materials, polymeric materials or the like.

In another embodiment of the third aspect of the present invention, the protective headwear cover is constructed of Nylon.

In another embodiment of the third aspect of the present invention, the protective headwear cover is constructed of a fabric blend of Nylon and Lycra.

In still another embodiment of the third aspect of the present invention, the protective headwear cover is constructed of a fabric blend of polyester and Spandex®.

The preferred protective device for caps such as baseball caps, according to various embodiments of the present invention, offers the following advantages: ease of use; lightness in weight; durability; excellent water-resistant or waterproof characteristics; the ability to protect the quality and integrity of the cap; the ability to protect the investment of the hat by ensuring that it is not ruined by weather damage, staining, debris, fading and color bleeding; the ability to provide a barrier between the cap and everyday elements, such as rain, snow, and heat; and the ability to provide a cover in various colors and designs to offer a new and unique style. In fact, in many of the preferred embodiments, these advantages are optimized to an extent that is considerably higher than heretofore achieved in prior, known protective device for caps such as baseball caps.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

Figure 2:
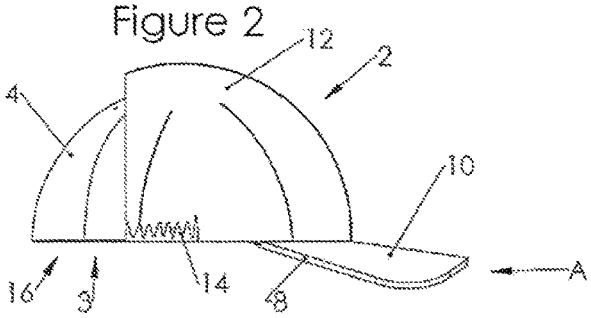
(Prior Art) Figure 2
FIG. 2 is a side view of the water-resistant or waterproof hat cover or CapSkinz being partially placed over the cap, according to the present invention.

In order to address the shortcomings of the prior, known protective device for caps such as baseball caps, reference is made now to FIG. 2, where there is illustrated water-resistant or waterproof hat cover or CapSkinz 2. As will be explained hereinafter in greater detail, the water-resistant or waterproof hat cover or CapSkinz 2 is designed to protect a cap such as a baseball cap from the elements. The CapSkinz protects the investment of a cap by ensuring that it is not ruined by weather damage. The CapSkinz offers a barrier between the cap and everyday elements, such as rain, snow, and heat. Finally, the CapSkinz allows individuals to protect their hat, while also providing a cover in various colors and designs to offer a new and unique style.

Figure 1:
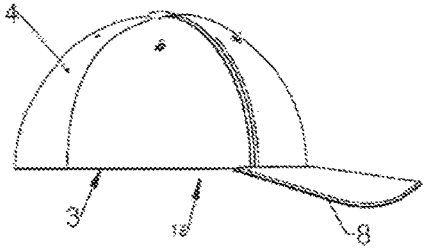
FIG. 1 is a side view of a conventional cap such as a baseball cap, according to the prior art.

As shown in FIG. 1, cap 3, includes, in part, crown 4, visor 8 and sweat band area 16. It is to be understood that crown 4, visor 8, and sweat band area 16 are well known components of the conventional cap 3 such as a baseball cap.

Figure 3:
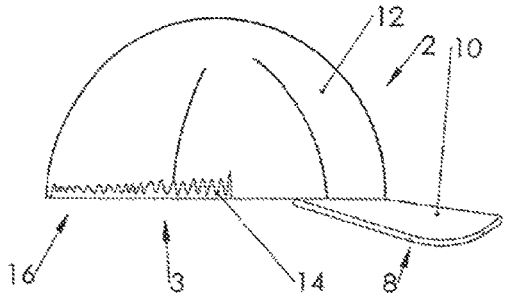
FIG. 3 is a side view of the water-resistant or waterproof hat cover or CapSkinz being completely placed over the cap, according to the present invention.
Figure 4:
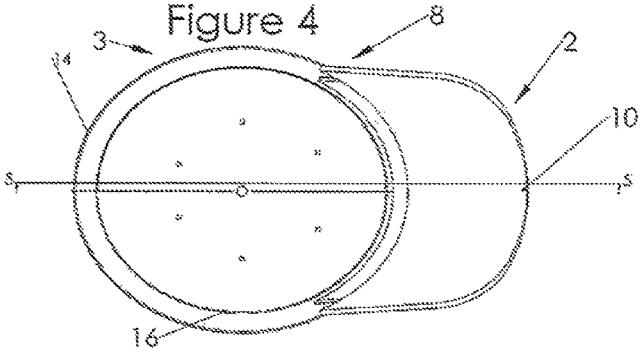
FIG. 4 is a bottom view of the water-resistant or waterproof hat cover or CapSkinz being completely placed over the cap, according to the present invention.

As shown in FIGS. 2-4, there is illustrated a conventional cap 3 such as a baseball cap 3, being covered by the water-resistant or waterproof hat cover or CapSkinz 2 (FIG. 2), according to the present invention. With respect to water-resistant or waterproof hat cover or CapSkinz 2, water-resistant or waterproof hat cover or CapSkinz 2, includes, in part, visor cover section 10, crown cover section 12, and adjustable band 14. A unique aspect of the present invention is that visor cover sect n 10, crown cover section 12 and adjustable band 14 are constructed as a one-piece design so that water-resistant or waterproof hat cover or CapSkinz 2 can be easily and quickly placed over the cap 3 so as to protect cap 3. It is to be understood that visor cover section 10, crown cover section 12 and adjustable band 14 can be connected together by well-known techniques such as stitching, adhesives, binding, fastening or the like.

As shown in FIG. 2, water-resistant or waterproof hat cover or CapSkinz 2 is located over cap 3 such that visor cover section 10 is placed over visor 8 of cap 3 in the direction of arrow A so that visor cover section 10 completely covers visor 8. Also, a portion of the crown cover section 12 is now covering a portion of crown 4 of cap 3. A further unique aspect of the present invention is that visor cover section 10 is to be constructed so that visor cover section 10 completely fits over and is retained by the visor 8 of cap 3.

With respect to FIG. 2, water-resistant or waterproof hat cover or CapSkinz 2 is further placed over cap 3 so that visor cover section 10 covers visor 8 of cap 3 and crown cover section 12 covers a larger portion of crown 4. Also, adjustable band 14 can be seen in FIG. 2. A still unique aspect of the present invention is that adjustable band 14 is used to retain snuggly the water-resistant or waterproof hat cover or CapSkinz 2 on cap 3, as will be described in greater detail later. Also, the visor cover section 10, crown cover section 12, and adjustable band 14 allow the water-resistant or waterproof hat cover or CapSkinz 2 to be form-fitted over a multitude of sizes of caps.

Regarding FIG. 3, water-resistant or waterproof hat cover or CapSkinz 2 is completely placed over cap 3 so that visor cover section 10 completely covers visor 8 of cap 3 and crown cover section 12 completely covers the outer side of crown 4. As can be more readily seen in FIG. 3, adjustable band 14 and visor cover section 10 are now utilized to assist in retaining water-resistant or waterproof hat cover or CapSkinz 2 on cap 3.

As shown in FIG. 4, a still further unique aspect of the present invention is shown in that, as seen from the underneath of water-resistant or waterproof hat cover or CapSkinz 2, the visor cover section 10 substantially fits over and is retained by the visor 8 of cap 3 and the adjustable band 14 is used to assist in retaining water-resistant or waterproof hat cover or CapSkinz 2 on cap 3. A yet further unique aspect of the present invention is the fact that adjustable band 14, preferably, is located adjacent to and along the sweatband area 16 of the cap 3 and does not extend into the interior or the area of the cap 3 that comes into contact with the head of the cap wearer. In this manner, the wearer of the water-resistant or waterproof hat cover or CapSkinz 2 and the cap 3 should not be able to sense that the water-resistant or waterproof hat cover or CapSkinz 2 has been placed over the cap 3. It is to be understood that adjustable band 14 is constructed of any suitable elastic material that is capable of stretching out and returning to its original shape once the water-resistant or waterproof hat cover or CapSkinz 2 has been removed from cap 3. However, the elastic nature of adjustable band 14 should not be so great as to push in or otherwise deform cap 3 once water-resistant or waterproof hat cover or CapSkinz 2 has been placed completely over cap 3. It is to be further understood that adjustable band 14 can be formed around a periphery of crown cover section 12 by conventional techniques such as stitching, adhesives, stapling or the like. It is to be further understood that adjustable band 14 may extend along a length of the crown cover section 12, wherein the adjustable band 14 can be located adjacent to the visor cover section 10. Furthermore, the adjustable band 14 may be located adjacent to and along a portion of the sweat band area 16 and does not extend into an area of the crown 4 that comes into contact with the head of the end user. Finally, the adjustable band 14 may be formed only around a periphery of the crown cover section 12.

Figure 5:
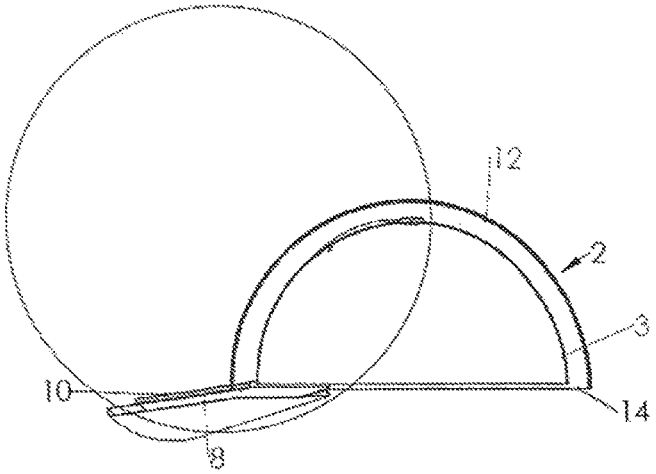
FIG. 5 is a cut-away view of the water-resistant or waterproof hat cover or CapSkinz being completely placed over the cap, taken along lines 5-5 in FIG. 4, according to the present invention.

Regarding FIG. 5, a cross-sectional view of water-resistant or waterproof hat cover or CapSkinz 2 being placed over cap 3 is illustrated. As can be seen in FIG. 5, water-resistant or waterproof hat cover or CapSkinz 2 is constructed so as to be form-fitted over cap 3 and visor cover section 10 completely covers visor 8 and crown cover section 12 completely the covers the outer side of crown 4.

Figure 6:
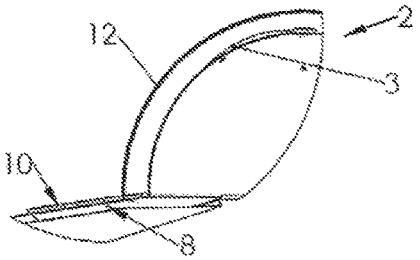
FIG. 6 is an expanded view of the water-resistant or waterproof hat cover or CapSkinz being completely placed over the cap, taken from area 6 in FIG. 5, according to the present invention.

FIG. 6 shows a more detailed view of the location of visor cover section 10 with respect to visor 8 and crown cover section 12 with respect to crown 4. It is to be understood that water-resistant or waterproof hat cover or CapSkinz 2 can be constructed of various durable, fade resistant, UV stabilized, temperature resistant, and wear resistant materials such as fabric, leather, cellulose materials, polymeric materials or the like. For example, in one embodiment, the water-resistant or waterproof hat cover or CapSkinz 2 can be constructed of Nylon®. In a second embodiment, the water-resistant or waterproof hat cover or CapSkinz 2 can be constructed of a fabric blend of Lycra® and Nylon®. In this embodiment, the fabric blend, preferably, is a blend of 15% Lycra® and 85% Nylon®. In a third embodiment, the water-resistant or waterproof hat cover or CapSkinz 2 can be constructed of a fabric blend of polyester and Spandex®. In this embodiment, the fabric blend, preferably, is a blend of 96% polyester and 4% Spandex®. An even further unique aspect of the present invention is that the fabric blend of polyester and Spandex® provides a water-resistant or waterproof hat cover or CapSkinz 2 that can be conventionally printed upon in various colors and custom designs to offer a new and unique style. It is to be further understood that while various colors and custom designs can be printed on the water-resistant or waterproof hat cover or CapSkinz 2, other well-known techniques such as decals, stitching, dyeing, heat sensitive adhesives or the like can be used to apply various colors and designs to the water-resistant or waterproof hat cover or CapSkinz 2.

It is to be understood that due to the fact that water-resistant or waterproof hat cover or CapSkinz 2 reflects UV rays, the water-resistant or waterproof hat cover or CapSkinz 2 should substantially reduce the adverse effects of the UV rays on the face and head of the wearer and, therefore, reduce the sun damage on the face and head of the wearer.

With respect to the water-resistant or waterproof aspect of the present invention, once the desired material for water-resistant or waterproof hat cover or CapSkinz 2 has been determined, and the desired graphical designs have been applied to water-resistant or waterproof hat cover or CapSkinz 2, a conventional water-resistant or waterproofing material is conventionally applied to the desired material in order to provide the desired water-resistant or waterproof characteristics of water-resistant or waterproof hat cover or CapSkinz 2. It is to be further understood that a conventional ultraviolet (UV) resistant material is conventionally applied to the desired material in order to provide the desired UV resistant characteristics of the hat cover or CapSkinz 2.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those skilled in the art will recognize, that the invention embraces and is also thereby described in terms of any individual member or subgroup of members of the Markush group.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled in the art without departing from the spirit and the scope of the invention as claimed. Accordingly, the description hereinabove is not intended to limit the invention, except as indicated in the appended claims.

Therefore, provided herein is a new and improved protective device for caps such as baseball caps. The preferred protective device for caps such as baseball caps, according to various embodiments of the present invention, offers the following advantages: ease of use; lightness in weight; durability; excellent water-resistant or waterproof characteristics; the ability to protect the quality and integrity of the cap; the ability to protect the investment of the hat by ensuring that it is not ruined by weather damage, staining, debris, fading and color bleeding; the ability to provide a barrier between the cap and everyday elements, such as rain, snow, and heat; and the ability to provide a cover in various colors and designs to offer a new and unique style. In fact, in many of the preferred embodiments, these advantages of ease of use, lightness in weight, durability, excellent water-resistant or waterproof characteristics, the ability to protect the quality and integrity of the cap, the ability to protect the investment of the hat by ensuring that it is not ruined by weather damage, staining, debris, fading and color bleeding, the ability to provide a barrier between the cap and everyday elements, such as rain, snow, and heat, and the ability to provide a cover in various colors and designs to offer a new and unique style are optimized to an extent that is considerably higher than heretofore achieved in prior, known protective device for caps such as baseball caps.

I claim:

1. A headwear apparatus for covering and protecting an article of headwear such as a cap, comprising:

an article of headwear having a head receiving portion sized to receive the head of a user when the headwear is worn by the user, a forward extending visor attached to the head receiving portion, and a sweat band located around a periphery of the head receiving portion; and a protective headwear cover that covers and protects the article of headwear, wherein the protective headwear cover is further comprised of a fabric blend of 96% polyester and 4% spandex, and wherein the protective headwear cover further comprises;

a protective headwear cover head receiving portion connected together to a separate protective headwear cover visor portion, wherein the protective headwear cover head receiving portion is located over the head receiving portion and is sized to fit only over the head receiving portion and the separate protective headwear cover visor portion is located over the visor and is sized to fit only over the visor, wherein a portion of a periphery of the protective headwear cover head receiving portion includes an adjustable band which extends along a length of the protective headwear cover head receiving portion wherein the adjustable band is located adjacent to the protective headwear cover visor portion and the adjustable band is located adjacent to and along a portion of the sweat band and does not extend into an area of the head receiving portion that comes into contact with the head of the user and the adjustable band is formed only around a periphery of the protective headwear cover head receiving portion, and a water-resistant material applied to the protective headwear cover.

2. A slip-on cover or covering and protecting an article of headwear such as a cap, comprising:

an article of headwear having a head receiving portion sized to receive the head of a user when the headwear is worn by the user, a forward extending visor attached to the head receiving portion, and a sweet band portion located around a periphery of the head receiving portion; and a protective headwear cover that covers and protects the article of headwear, wherein the protective headwear cover is further comprised of a fabric blend of 85% nylon and 15% spandex, and wherein the protective headwear cover further comprises;

a protective headwear cover head receiving portion connected together to a separate protective headwear cover visor portion, wherein the protective headwear cover head receiving portion is located over the head receiving portion and is sized to fit only over the head receiving portion and the separate protective headwear cover visor portion is located over the visor and is sized to fit only over the visor, wherein a portion of a periphery of the protective headwear cover head receiving portion includes an adjustable band which extends along a length of the protective headwear cover head receiving portion wherein the adjustable band is located adjacent to the protective headwear cover visor portion and the adjustable band is located adjacent to and along a portion of the sweat band and does not extend into an area of the head receiving portion that comes into contact with the head of the user and the adjustable band is formed only around a periphery of the protective headwear cover head receiving portion, and a water-resistant material applied to the protective headwear cover.

* * * * *